United States Patent [19]

Shaw, Sr. et al.

[11] Patent Number: 4,558,583

[45] Date of Patent: Dec. 17, 1985

[54] MOBILE PIPE BENDING CARRIAGE

[76] Inventors: Robert A. Shaw, Sr., 2218 Holland St., West Columbia, S.C. 29169; Robert A. Shaw, Jr., Rte. 6, Box 281, Lexington, S.C. 29071

[21] Appl. No.: 577,680

[22] Filed: Feb. 7, 1984

[51] Int. Cl.[4] ..... B21D 9/05

[52] U.S. Cl. ..... 72/389; 72/369; 72/157; 269/17

[58] Field of Search ..... 72/389, 369, 446, 442, 72/34, 35, 36, 32, 157, 455; 33/371; 248/188.1; 74/16; 269/17, 296

[56] References Cited

U.S. PATENT DOCUMENTS

| | | | |
|---|---|---|---|
| 2,190,585 | 8/1936 | Rhinevault | 145/29 A |
| 2,621,702 | 12/1952 | Peddinghaus et al. | 153/40 |
| 3,396,565 | 8/1968 | Miller | 72/216 |
| 3,760,626 | 9/1973 | Sharar | 72/389 |
| 3,844,158 | 10/1974 | Mercer | 72/455 |
| 3,918,286 | 11/1975 | Whitehead | 72/213 |
| 3,935,721 | 2/1976 | Boteler | 72/22 |
| 3,949,584 | 4/1976 | Fearson et al. | 72/149 |
| 3,981,173 | 9/1976 | Nobinger | 72/389 |
| 4,265,106 | 5/1981 | McMaster et al. | 72/389 |
| 4,341,104 | 7/1982 | Jarman | 72/389 |
| 4,394,799 | 7/1983 | Moree et al. | 33/371 |

*Primary Examiner*—Francis S. Husar
*Assistant Examiner*—Robert Showalter
*Attorney, Agent, or Firm*—Benoni O. Reynolds

[57] ABSTRACT

A mobile pipe bending carriage, for storing and transporting bending equipment used in making radius bends in pipe, conduit, tubing and the like, having a mobile carriage structure with:

(1) mounting attachment means for mounting thereon any one of various makes of conventional three-point bending frame assemblies, in a stationary, vertical, operating position;

(2) rack means for storing different sized bending shoes;

(3) swivel-type casters for mobility;

(4) leveling means for stability during bending operations;

(5) cradle means for mounting a hydraulic pump, an electric motor and a locker for the storage of small tools and accessories used in bending operations;

(6) a detachable leveling clamp, used with the bending frame assembly, for accurately gauging and aligning the bending of pipe, conduit, tubing and the like.

1 Claim, 6 Drawing Figures

69
63
65
67
66
64
68
15
16
17
18
4
10
12
70
68
26
21
13
43
43
14
36
23
38
22
62
35
25
61
60
32
4

15
16
18
11
12
21
10
27
26
39
40
34
36
48
46
51
50
48
51
50
47
32
31
47
49
52
49

53
56
54
41
55
42
40
39
58
43
34
36
29
31
38
59
37
33
57
35
32
61
62
30
60

MOBILE PIPE BENDING CARRIAGE

BACKGROUND OF THE INVENTION

1. Field of Invention

This invention relates generally to the art of forming radius bends in pipe, conduit, tubing and the like. Particularly, this invention relates to a mobile carriage structure which may be used for mounting various makes and models of commercially available "three point" type pipe and conduit bending frame assemblies, in a stationary, upright, operating position. The mobile carriage structure has provision for storing different sized bending shoes and other accessories as well as for mounting a power source, such as a hydraulic pump and electric motor, for operating the hydraulic ram of the bending frame assembly. This invention also relates to a detachable leveling clamp for use in bending nonferrous metallic pipe or conduit with the bending frame assembly. This disclosure also relates to a method for producing single radius bends, or a series of spaced or offset radius bends ("following" bends), in nonferrous metallic pipe or conduit using a conventional "three-point" type bending frame assembly mounted in a stationary, vertical, operating position on the mobile carriage structure of the present invention and using the detachable leveling clamp of the present invention.

2. Description of Prior Art

Heretofore, in the pipe and conduit bending art, various arrangements for mounting "three point" type bending frame assemblies in an upright operating position have been provided. As exemplified by U.S. Pat. No. 3,396,565, previous mobile mounting arrangements have comprised a relatively long base, supported on wheels, pivotally mounting a bending frame assembly thereon. Also, such earlier devices were provided with clamping means for holding the length of pipe or conduit, in which a bend is to be formed, rigidly to the base during bending. During the bending operation, the bending frame assembly itself is caused to pivot about its mounting on the base, as the bend is formed, as shown in U.S. Pat. No. 3,760,626. Another earlier device provided a pivotal mounting for both the bending frame assembly and the supporting means holding the pipe or conduit, as disclosed in U.S. Pat. No. 3,981,173.

Still another earlier arrangement, known to these inventors, for mounting a tubing bender, is exemplified by U.S. Pat. No. 3,935,721, which discloses a "swinging-cam" type tubing bender disposed in a horizontal operating position on a framework mounted on casters for mobility. Other horizontally operated benders, known to these inventors, are shown in U.S. Pat. Nos. 3,844,158 and 3,918,286. The pipe-bending apparatus of U.S. Pat. No. 4,265,106 discloses a horizontally operated bender mounted on a sawhorse type frame upon which are mounted a hydraulic pump and electric motor as well as a means for storing forming heads (bending shoes) for bending pipe, when not in use.

Various makes and models of "three-point" bending frame assemblies are available commercially. These assemblies are typically used in a horizontal operating position, either on a floor at the job site, or upon a bench or platform in the shop of the contractor. A separate hydraulic pump is typically connected by a hose to the hydraulic ram of the bending frame assembly for actuating the hydraulic ram. When the bending operations have been completed at one location, the bending frame assembly, hydraulic pump, and various bending shoes are typically dismantled and packed into a large case or locker and transported therein to the next location where bending operations are to be performed. At the new job site the bending frame assembly, the hydraulic pump and the bending shoes must be unpacked and the hose from the hydraulic pump reconnected to the hydraulic ram, before further bending operations may proceed.

As long as the pipe or conduit being bent is of relatively small diameter, the bending frame assembly, hydraulic pump and bending shoes will typically be relatively small in size. Being thus lighter in weight, their transportation from location to location will not be overly difficult. One man can accomplish the move, although not always easily. However, when pipe or conduit of larger diameters are to be bent, the weight and size of the bending frame assembly alone may often require two or more men to transport the bender and set it up. Also, the hydraulic pump necessarily will be heavier and more bulky as will the electric motor which powers the pump. Where pipe or conduit of different diameters is to be bent at a variety of locations, various bending shoes will necessarily have to be transported as well from location to location. On large jobs, such as in the construction of multi-story buildings, where pipe and conduit bending operations must be performed in many locations, it becomes apparent that much time and effort will necessarily be expended just in transporting a bending frame assembly and its associated motorized hydraulic pump and various bending shoes from location to location. When the time and effort necessarily expended in just dismantling, packing, unpacking and setting up the bender at each location is added to the time and effort required for its transportation, it becomes more apparent that the use of the various commercially available bending frame assemblies entails the drawback of significant time and effort expended in performing these basically non-productive operations.

A further non-productive expenditure of time and effort will necessarily occur daily when the case or locker, in which the bending frame assembly, hydraulic pump and bending shoes are packed, must be transported to and from the secured overnight tool storage area, typically provided at construction sites, to and from the location where bending operations are to be performed during the workday. Loading the case or locker onto a wheeled cart for transporting, or mounting wheels or casters to the case or locker itself, facilitates transportation of the bender but still does not alleviate the amount of time and effort required to set up, dismantle, pack and unpack, the components of the bender themselves.

Another shortcoming, which becomes apparent as the bending frame assembly is typically positioned on the floor of the job site in a horizontal operating position, is that bending operations, especially when bends are to be performed in long lengths of pipe or conduit, require considerable unobstructed floor space to allow clearance for the ends of the pipe or conduit to swing as the bend is being formed. Associated with this space requirement is the difficulty of accurately gauging the desired degree of bend when the ends of the pipe or conduit, in which the bend is being formed, are swept across a horizontal plane.

Apparatus for mounting a bending frame assembly in a vertical operating position partially overcomes the disadvantages described above of horizontal operation.

However, prior art apparatus, as exemplified by U.S. Pat. Nos. 3,396,565, 3,760,626 and 3,981,173 are large in overall size in comparison to the actual bending frame assemblies mounted therein. Because of this large overall size, such prior art apparatus are more suited to shop use rather than use on location at the job site. Although the apparatus of U.S. Pat. Nos. 3,396,565 and 3,981,173 may be provided with supporting wheels for mobility, the size and weight of the apparatus requires at least two men for moving them from location to location. Also, as the overall length of these benders may exceed the interior of service elevators, these prior art apparatus cannot always be moved directly to the job site.

As can be concluded from the above observations, it is desirable to provide a compact, mobile apparatus, for mounting a bending frame assembly in a vertical operating position, which apparatus is easily transportable by one man and is simple in operation. Also the apparatus must have provisions for mounting a hydraulic power source, bending shoes of various sizes and accessories used in performing bending operations on pipe, conduit, tubing and the like.

Mounting the bending frame assembly in a vertical operating position offers obvious advantages in that the length of pipe, conduit or the like, in which bends are to be formed, will move only in a vertical plane rather than in a horizontal direction, that is, in a parallel plane relative to the vertical axis of excursion of the hydraulic ram of the bender. Also in a perpendicular plane relative to the horizontal plane of the floor or ground at the job site.

This vertical plane of movement (of the pipe, conduit, tubing and the like, in which bends are to be formed) permits gauging of the bend being formed by the use of an inclinometer and/or spirit level gauging instruments positioned upon the length of pipe, conduit, or the like, being bent. A device of the inclinometer type is illustrated in U.S. Pat. No. 3,396,565 and comprises an indexed circular dial with a swinging pendulum indicator arm. The device is frictionally attachable to a length of conduit by means of a releasable clamp chain to indicate degree of bend by the angular displacement of its indicator arm relative to its indexed circular dial. A number of other depth-or-degree of bend indicating means are discussed in U.S. Pat. No. 3,935,721.

Typically in gauging bends formed on vertically operating bending frame assemblies, an inclinometer and/or spirit level gauging instrument is attached by frictional clamping or magnetic means, along one or both ends of the length of pipe, conduit or tubing being bent. This procedure permits measuring of the angular displacement of the ends about the radius of the bend as it is being formed.

Often it is necessary to form two or more bends of different radii in a length of pipe, conduit or tubing. These bends may typically lie in the same vertical plane while having their radial bend centerpoints displaced or offset axially along the length of pipe ("following" bends), conduit or tubing. Typically, such compound or offset bends will have their radial bend centerpoints displaced above and below the length of pipe, conduit or tubing, as well, e.g. where "S" bends are being formed. In such cases it is often difficult, when using the bending apparatus and gauging instruments of the prior art, to assure that these offset bends are formed in the same plane with respect to one another. The clinometer device shown in U.S. Pat. No. 3,396,565, for example, while rigidly clampable to the tubing being bent, and therefore usable in an inverted position, such as when the tubing is rotated 180 degrees in the bending frame assembly, for forming an "S" bend, has inherent disadvantages in that, when used with the bending apparatus therein disclosed, there may not be sufficient clearance provided below the tubing to permit such inverted use of the clinometer. Even where sufficient clearance permits such inverted use, the dial index markings will face in the opposite direction, i.e. rearward, thus forcing the operator to peer around the other side of the apparatus in order to view the angular displacement of the indicator arm, making the bending operation awkward to control. Where clearances will not permit such gauging in inverted use and where bends in perpendicular planes are to be formed in the same length of tubing, the clamping means must be loosened and the gauging device rotated 180 or 90 degrees about the tubing. This reorientation must be precisely formed, to assure accurate alignment of the finished bends in relation to one another.

A common method for gauging bends being formed with vertically positioned bending frame assemblies, and one preferred by these inventors, involves the use of a type of inclinometer device known as a protractor level. This type of device combines an indexed protractor dial, similar to the indexed dial shown in U.S. Pat. No. 3,396,565, a spirit level, and a base portion which is pivoted about the centerpoint of the protractor dial. The protractor dial is provided with markings in an arc about its peripheral face indicating degrees of angular displacement about its center. The spirit level vial is mounted to the protractor dial in such manner as to align the axis of the level, (i.e. the longitudinal axis perpendicular to plumb and usually indicated by the bubble at rest, centered in the vial) in parallel relationship to the baseline of the protractor level (i.e., the axis describing an angular displacement of 180 degrees about the centerpoint and usually indicated as 90 degrees displaced about a "zero" or plumb line). The pivoted base portion is provided with a flat bottom surface which may also have a "V" grooved edge for placement upon a curved surface such as pipe or conduit. The bottom of the base portion may also be magnetized for attachment to ferrous metal surfaces. The upper edges of the base portion are provided with index markings aligned 180 degrees about the pivot center so that when the protractor level is placed upon a level surface the protractor baseline is aligned with the index markings of the base portion and the bubble is centered in the vial of the spirit level.

The dial of the protractor level is typically marked in major increments of fifteen degrees and multiples thereof. In this way, typical bends in lengths of pipe, conduit or tubing, from 15 degrees to 90 degrees, may be gauged by simply aligning the base portion index lines with the incremented degree markings on the protractor dial corresponding to the desired degree of bend. Once the desired degree of bend has been dialed in, the protractor level is placed upon the top surface of the length of pipe or conduit being bent. Then the bend is formed until the bubble in the spirit level vial is centered in the "level" position, at which point the desired degree of bend dialed in has been reached.

Where compound, offset or "S" bends are to be formed ("following" bends), and where the conduit being bent is of nonferrous metal, it is still difficult to assure accurate alignment of bends when using a protractor level. This difficulty arises because the conduit in these situations must be rotated and conventional protractor levels are suited only for placement atop the conduit. Even when provided with a "v" grooved, magnetized base, the protractor level must be accurately reoriented atop the rotated conduit before forming can be continued.

Thus, it is desirable to provide a means by which accurate alignment of compound bends in the same plane may be easily and consistently accomplished on verticlly mounted bending frame assemblies, yet permit the use of conventional protractor level gauging instruments for monitoring the degree of each bend formed.

Prior art known to these inventors includes the following U.S. Pat. Nos.:

| | | |
|---|---|---|
| 2,621,702 | 12/1952 | Peddinghaus et al |
| 3,396,565 | 8/1968 | Miller |
| 3,760,626 | 9/1973 | Sharar |
| 3,844,158 | 10/1974 | Mercer |
| 3,918,286 | 11/1975 | Whitehead |
| 3,935,721 | 2/1976 | Boteler et al |
| 3,949,584 | 4/1976 | Pearson et al |
| 3,981,173 | 9/1976 | Nobinger |
| 4,265,106 | 5/1981 | McMaster et al |

BRIEF SUMMARY OF THE INVENTION

The present invention is a mobile carriage structure, of tubular frame construction, having mounting attachment means adapted for rigidly mounting thereon any one of the various, commercially available, three-point, hydraulic ram powered, bending frame assemblies. The selected three-point bending frame assembly is mounted in a stationary, vertical, operating position along with a source of hydraulic power for the hydraulic ram.

The mobile carriage structure of the present invention further provides:

rack means for the convenient mounting and storage thereon of the various sized bending shoes which are typically required for bending pipe, conduit, tubing and the like, of differing diameters;

swivel-type casters for mobility;

leveling means, in the form of retractable leveling jacks, for stabilizing the mobile carriage strucure during bending operations;

cradle means for mounting a hydraulic pump, an electric motor to drive the hydraulic pump, and a locker for storing small tools and accessories used in bending operations;

a detachable leveling clamp, of simple construction, to be used with the bending frame assembly for easily, accurately, and consistently, aligning and gauging the forming of bends in pipe, conduit, tubing and the like. This detachable leveling clamp of the present invention is especially helpful when bending nonferrous metallic conduit and tubing where magnetized leveling devices are difficult to use.

The mobile carriage structure of the present invention is of tubular frame construction and is completely self-contained, mounting thereon a conventional three-point bending frame assembly, a plurality of different sized bending shoes, a source of bending power, and a tool locker for storing tools and accessories. For mobility, the mobile carriage structure is supported upon swivel-type casters. For stability, the mobile carriage structure is provided with retractable leveling jacks.

The frame of the mobile carriage structure may typically be of welded construction using round, square or rectangular tubing. Opposed horizontal lower transverse frame members are provided at their ends with swivel-type casters. Extending upwardly from and intermediate the ends of the lower transverse frame members, are opposed pairs of vertical support frame members. Intermediate the upper ends of these vertical support frame members and their lower juncture with the lower transverse frame members, are opposed transverse bracing members which extend horizontally between the vertical support frame members and in perpendicular relationship with the lower transverse frame members.

Extending horizontally across the upper ends of the vertical support frame members, in parallel relationship with the transverse bracing members, are mounting attachment means comprised in part of opposed bending frame mounting members. The bending frame mounting members are constructed, in the preferred embodiment of the present invention, of square or rectangular box section tubing. Affixed to the opposing inner faces of the bending frame mounting members are spaced hub plates. These hub plates, which may be affixed at various locations along the inner opposing faces of the bending frame mounting members, with the bending frame mounting members, provide mounting attachment means adapted to rigidly mount the various commercially available three-point bending frame assemblies in a vertical operating position.

Rack means for storing the different sized bending shoes are provided by vertical rack members. These vertical rack members are typically constructed of flat plate, with spaced pegs of round bar steel stock, affixed at right angles along one side thereof, the whole vertical rack member being vertically aligned and affixed to the frame of the mobile carriage structure.

Cradle means for mounting a hydraulic pump, an electric motor and a locker, comprises a shelf and a tray. The shelf typically constructed of flat plate, is affixed horizontally across the top surfaces of the lower transverse frame members, proximate the castered ends thereof and their juncture with one pair of the vertical support frame members, so as to span the lower transverse frame members in perpendicular relationship therewith. The tray, constructed typically of flat plate or sheet metal and having a bottom surface enclosed peripherally by short side walls, are affixed horizontally atop the shelf spanning the lower transverse frame members.

Leveling means, comprising retractable leveling jacks which are constructed from threaded shafts, made from lengths of threaded stock. Each threaded shaft has a crank handle affixed to its upper end and a foot plate affixed at its lower end, with the threaded shaft engaging nut means positioned mediately the ends thereof. The threaded shafts are each affixed, via the nut means, to the outer end of a telescoping tube member oriented in perpendicular relationship with respect to each threaded shaft. The telescoping tube member is a length of hollow tubing sized such that its outside diameter is just slightly less than the inside diameter of the tubing comprising the lower transverse frame members. Thus, the telescoping tube member, with affixed leveling means, may be slidably engaged within the open ends of the castered lower transverse frame members.

The detachable leveling clamp of the present invention comprises a length of round bar stock to which is affixed, in perpendicular relationship therewith, mediately its ends, a clamping bracket and a leveling platform. The clamping bracket is typically comprised of a bent length of bar stock which overlies the length of bar stock in one plane along its length and which is provided at its free end with a threaded hole engaging a threaded clamping screw constructed similarly to the aforedescribed leveling means, having a threaded shaft with a crank handle affixed at one end and a foot plate affixed at its opposite end. The leveling platform is a length of thin plate stock affixed proximate the end of the length of round bar stock opposite the overlying clamping bracket, in perpendicular relationship with the plane of the clamping bracket, and in tangential and perpendicular relationship with the length of round bar stock.

OBJECTIVES OF THE INVENTION

The objectives of the present invention are to provide a mobile carriage structure which includes provisions for:

(1) mounting a conventional three-point bending frame assembly rigidly thereon in a stationary vertical operating position for the forming of bends in pipe, conduit, tubing and the like;

(2) mounting any one of a variety of makes and models of commercially available three-point bending frame assemblies rigidly thereon in a stationary vertical operating position for the forming of bends in pipe, conduit, tubing and the like;

(3) rack means for the storage of bending shoes of various sizes;

(4) cradle means for mounting thereon a source of bending power for actuating a three-point bending frame assembly and a locker for the storage of small tools and accessories used in bending operations;

(5) leveling means to provide stability while performing bending operations;

(6) a detachable leveling clamp for use with bending frame assemblies mounted on the mobile carriage structure for accurately gauging and aligning bends formed in pipe, conduit, tubing and the like;

Other objectives and advantages of the present invention will be apparent during the course of the following detailed description, appended claims and accompanying drawings.

DETAILED DESCRIPTION OF THE PREFERRED EMBODIMENT OF THE INVENTION

Figure 1:
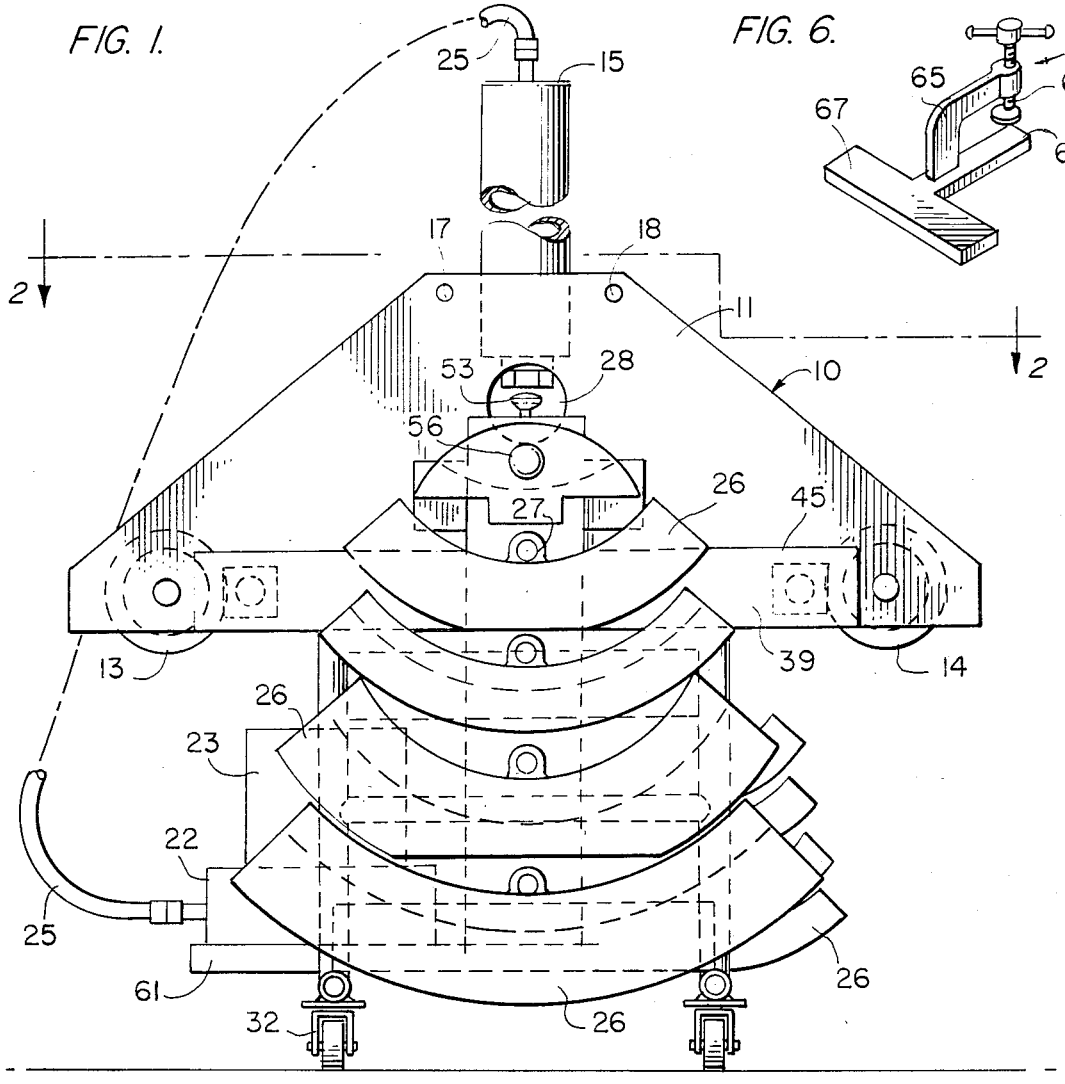
FIG. 1 is a front elevational view of the mobile carriage structure, constructed in accordance with the principles of the present invention, with a three-point bending frame assembly, a source of bending power, and bending shoes of different sizes, mounted thereon.

The Mobile Pipe Bending Carriage is a versatile, self-contained bending shop on swivel-type casters, which has mounted thereon all the necessities for complete bending services. It can be quickly and easily moved from job site to job site or location to location on a job site. Throughout the following detailed description of the present invention like reference numerals are used to denote like parts disclosed in the accompanying drawings, FIGS. 1-6. Shown in a vertical operating position in FIG. 1, is a conventional three-point bending frame assembly 10 comprised typically of frame plate 11 and frame plate 12, with concave roller 13, concave roller 14 and hydraulic cylinder 15 mounted therebetween.

Figure 2:
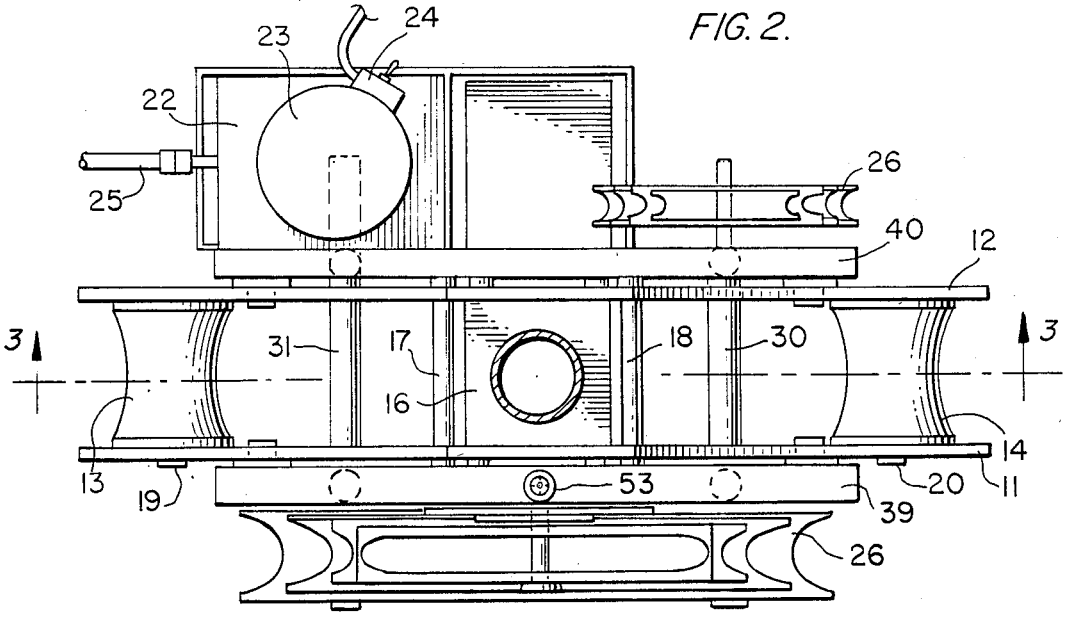
FIG. 2 is a top, partial sectional view of the present invention taken substantially along line 2—2 of FIG. 1.
Figure 3:
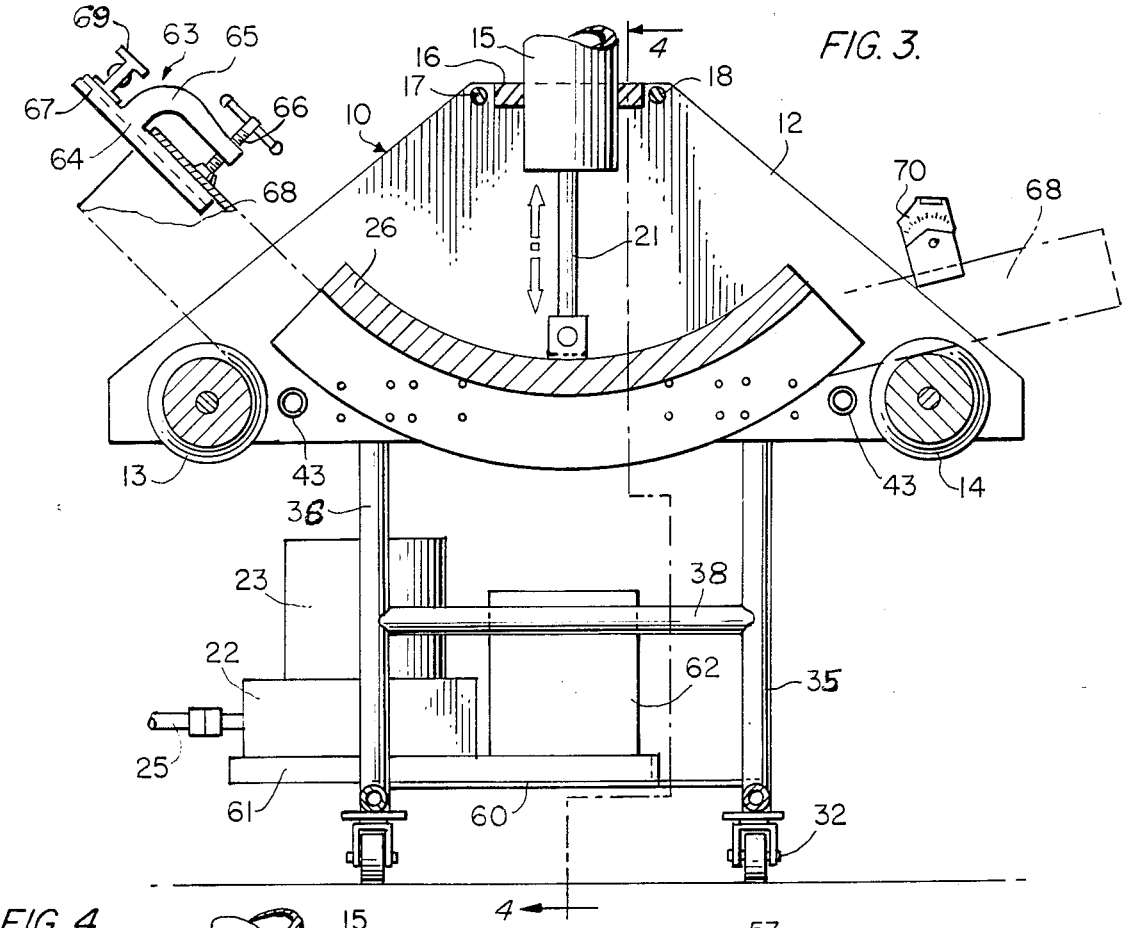
FIG. 3 is a front sectional view taken along line 3—3 of FIG. 2, showing a bend being formed in a length of pipe, conduit, tubing or the like and further showing the detachable leveling clamp of the present invention in use.

Referring to FIGS. 2 and 3, it may be seen that bending frame assembly, indicated generally at reference numeral 10, is further comprised of hydraulic cylinder mounting plate 16. Frame plate bolt 17 and frame plate bolt 18 maintain frame plate 11 and frame plate 12, respectively, in assembled relationship to one another at their upper edges. Similarly, roller bolt 19 and roller bolt 20 maintain frame plate 11 and frame plate 12, respectively, in assembled relationship to one another at their lower edges. Roller bolt 19 and roller bolt 20 further serve as axles upon which concave roller 13 and concave roller 14, respectively, may freely rotate between frame plate 11 and frame plate 12.

Hydraulic cylinder 15 is of the single-acting type and is typically provided with a hydraulic ram 21 having a piston, not shown, which is movable vertically in extension and retraction under hydraulic pressure applied to hydraulic cylinder 15. Hydraulic pressure is typically developed by hydraulic pump 22 which in turn is typically driven by electric motor 23 under control of three-position, normally off, switch 24, shown in FIG. 2.

Hydraulic pressure developed in hydraulic pump 22 is applied to hydraulic cylinder 15 via flexible hydraulic line 25. Typically, throwing switch 24 actuates electric motor 23 to drive hydraulic pump 22 which develops hydraulic pressure. This pressure in turn is applied by hydraulic line 25 to hydraulic cylinder 15 by moving a pressure extent/release lever, not shown, into "extend ram" position, causing hydraulic ram 21 to be extended downwardly. A compression spring, not shown, within hydraulic cylinder 15, acts against the extension of hydraulic ram 21 and is caused to be compressed when hydraulic pressure is applied to hydraulic cylinder 15 extending hydraulic ram 21. Conversely, moving the pressure extend/release lever into its "retract ram" position, causes the hydraulic pressure, applied via hydraulic line 25 to hydraulic cylinder 15, to be reduced. When the hydraulic pressure applied to hydraulic cylinder 15 is thus reduced, the compression spring within hydraulic cylinder 15 causes hydraulic ram 21 to be retracted upwardly within hydraulic cylinder 15.

Alternately, hydraulic cylinder 15 may be of the double-action type whereby extension and retraction of hydraulic ram 21 would be caused by application of hydraulic pressure to alternating sides of its piston. Such an arrangement is more complicated and therefore it is preferable to employ single-action hydraulic cylinders for the sake of simplicity and reliability.

Hydraulic ram 21 is connectable at its end opposite hydraulic cylinder 15 to any one of various different sized bending shoes 26 by adapters, not shown, and known fastening means, such as by a pin or bolt, insertable through aligned holes in the end of hydraulic ram 21 and yoke 27 provided on each of the bending shoes 26. Bending shoes 26 are commercially available in various sizes and configurations for forming bends in pipe, conduit, tubing and the like of different diameters. Typically, bending shoes 26 are formed in the shape of circular segments and provided with contact surfaces configured so as to conform to the outside diameter of the pipe, conduit or tubing being bent.

Similarly, concave roller 13 and concave roller 14, respectively, are typically provided with contact surfaces configured so as to conform to the outside diameter of the pipe, conduit or tubing being bent. Alternatively, there may be provided, instead of concave roller 13 and concave roller 14, a pair of pivot shoes, not shown, which have formed about their peripheries, a plurality of separate, concavely profiled guide surfaces, conforming to the outside diameters of different sizes of pipe, conduit or tubing or the like. These pivot shoes may be rotated about roller bolt 19 and roller bolt 20, respectively, so as to present the desired profiled surface conforming to the diameter of the pipe, conduit or tubing to be bent. This profiled surface will likewise correspond to that of bending shoes 26 installed in bending frame assembly 10.

An aperture 28 is typically provided in frame plate 11 and frame plate 12, to permit access to the bending shoe fastening means, allowing for the convenient connection (or disconnection) of bending shoes 26 to hydraulic ram 21.

As thus far described, three-point bending frame assembly 10 is typical of various and commercially available makes and models of bending frame assemblies which may be used with the mobile carriage structure and the detachable leveling clamp of the present invention, for forming bends in pipe, conduit, tubing and the like. Those bending frame assemblies manufactured by Greenlee Bros. & Co. of Rockford, Ill. as Models 883 and 884 benders, are especially typical and have been used successfully with the present invention. However, it is in no way desired that the present invention be limited to use with any particular make or model of bending frame assembly. As will be more fully described below, the mobile carriage structure presented here may be adapted to accommodate various makes and models of commercially available three-point bending frame assemblies in a stationary vertical operating position.

Figure 4:
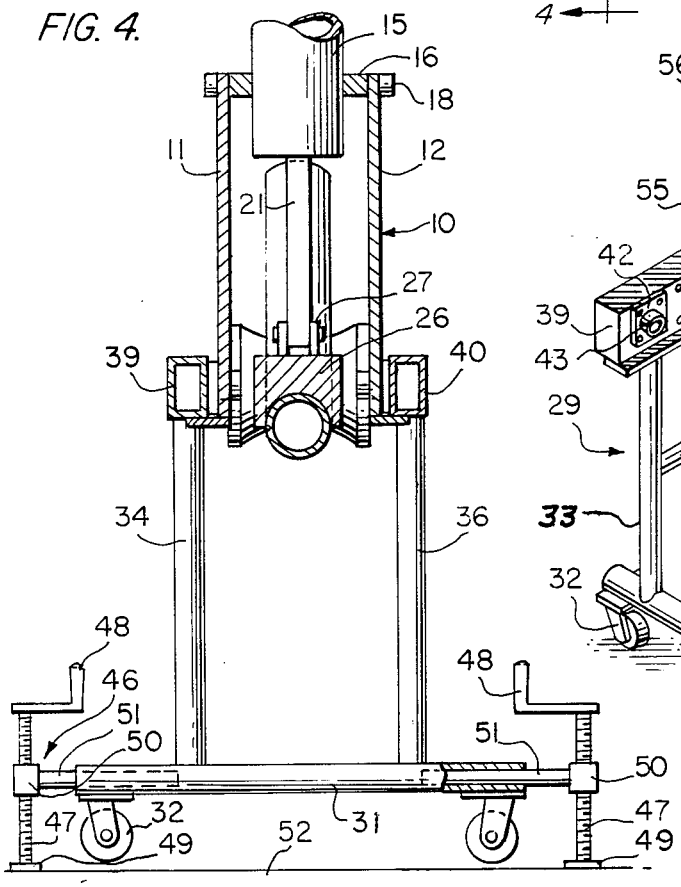
FIG. 4 is a right sectional view taken substantially along line 4—4 of FIG. 3 and further showing the leveling means of the mobile carriage structure of the present invention in use.
Figure 5:
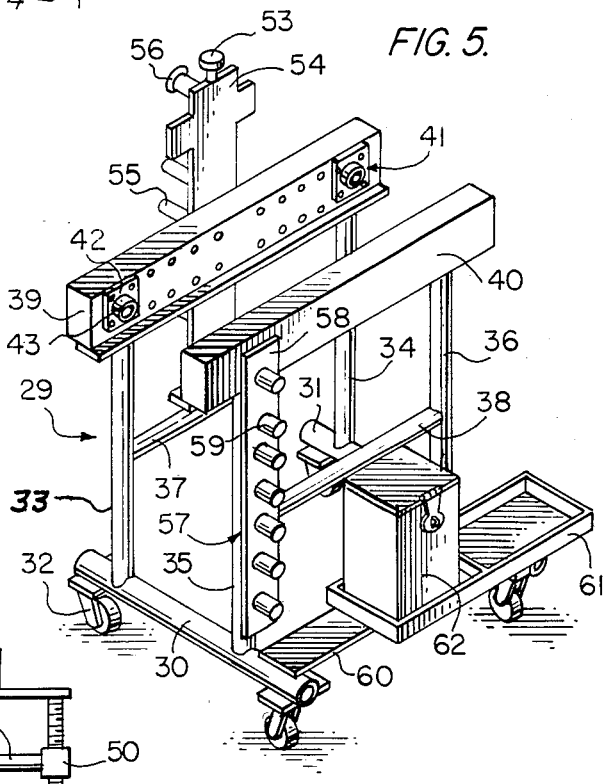
FIG. 5 is an elevational perspective view of the mobile carriage structure of the present invention showing the rack means and the cradle means, in place thereon.

Referring now to FIGS. 3, 4 and 5, the mobile carriage structure of the present invention, indicated generally at reference number 29, is of welded frame construction. This framework is preferably constructed from straight lengths of steel tubing because of its moderate cost, weldability and availability in a variety of sizes and shapes. However, other suitable materials, such as aluminum, may be used. Tubing of round, square or rectangular box section may be employed.

Mobile carriage structure 29 is provided with opposed horizontal lower transverse frame members 30 and 31. The ends of lower transverse frame members 30 and 31, respectively, are supported by swivel-type casters 32. Swivel-type casters 3Z are preferably six inches or more in diameter, so as to permit mobile carriage structure 29 to be easily moved across uneven surfaces and negotiated over floor gaps such as expansion joints. Preferably, swivel-type casters 32 have ball bearings and their caster swivel plates are welded to the ends of lower transverse frame members 30 and 31, respectively.

Extending upwardly from, and intermediate the castered ends of lower transverse frame members 30 and 31, are opposed vertical support frame members 33, 34, 35 and 36. Intermediately between the upper ends of vertical support frame members 33, 34, 35 and 36, respectively, and the lower junctures of said vertical support frame members with lower transverse frame members 30 and 31, are opposed transverse bracing members 37 and 38. Transverse bracing members 37 and 38, respectively, extend horizontally between and in perpendicular relationship with vertical support frame members 33, 34, 35 and 36 and in perpendicular relationship with respect to lower transverse frame members 30 and 31.

Extending horizontally across the upper ends of vertical support members 33 and 34, respectively, and of vertical support members 35 and 36, respectively, in parallel relationship with transverse bracing members 37 and 38, are mounting attachment means, comprising in part opposed bending frame mounting members 39 and 40. While vertical supporting frame members 33, 34, 35 and 36 of mobile carriage structure 29, thus far described, may suitably be constructed from lengths of round tubing, it is preferred, although not essential to the present invention, that bending frame mounting members 39 and 40 be constructed from square or rectangular box section tubing for reasons which will be made more apparent below.

As may be seen in FIG. 5, the inner opposing vertical faces of bending frame mounting members 39 and 40 may be provided with a plurality of drilled and tapped holes aligned in two horizontal rows at regularly centered intervals. Affixed to the inner opposing vertical faces of bending frame mounting members 39 and 40 are further mounting attachment means comprising hub plates, indicated generally by reference numeral 41. Hub plates 41 are comprised of a plate 42 to which is welded a cylindrical hub 43. Plate 42 is preferably of steel, square or rectangular in shape. Cylindrical hub 43 is preferably a short length of round steel tubing centered upon, and welded, in perpendicular relationship, to plate 42. Plate 42 has drilled through holes at its four corners which holes are arranged so as to align with the drilled and tapped holes provided along the inner opposing vertical faces of bending frame mounting members 39 and 40. Thus, hub plates 41 may be bolted thereto in any of a number of locations.

A circular aperture (not shown), having an internal diameter providing an interference fit with the outside diameter of cylindrical hub 43, may be provided in the center of plate 42, making it possible to apply heat around the periphery of the aperture, increasing its diameter under thermal expansion and permitting cylindrical hub 43 to be inserted therein. When plate 42 is allowed to cool, the diameter of the circular aperture will decrease its diameter under thermal contraction, providing an interference fit with the length of cylindrical hub 43 inserted therein. Cylindrical hub 43 may also be welded to plate 42, as pointed out previously.

Referring once again to FIG. 3, there are commonly provided, proximate the lower edges of frame plates 11 and 12, two or more circular apertures 44. In certain models of conventional three-point bending frame assemblies, which have outer reinforcing plates (not shown) along the lower edges of their frame plates 11 and 12, the apertures 44 may be provided in these outer reinforcing plates. Alternatively, it is possible to mount narrow reinforcing plates 45, shown in FIG. 1, along the lower outer edges of frame plates 11 and 12. Reinforcing plates 45 have circular apertures 44, shown in FIG. 3, which are spaced from one another upon centers corresponding to the centered locations of hub plate means 41 affixed to bending frame mounting members 39 and 40.

In any case, it is preferred to construct hub plate 41 so that the outside diameter of its cylindrical hub 43 is slightly less than the internal diameter of circular apertures 44, thus permitting its cylindrical hub 43 to engage circular apertures 44 with a tight, yet slidable, fit therein. In this manner it is possible to rigidly mount bending frame assembly 10 in a vertical operating position, raised off the floor surface, upon mobile carriage structure 29, and to distribute the weight of mounted bending frame assembly 10, through frame plates 11 and 12, via cylindrical hub 43 and plate 42, to bending frame mounting members 39 and 40, lower transverse frame members 30 and 31, vertical support frame members 33–36 and transverse bracing members 37 and 38, of mobile carriage structure 29.

In order to make the mobile pipe bending carriage more stable, when working over uneven ground or floor surfaces at the job site, leveling means, shown generally by reference numeral 46, are provided. Shown in FIG. 4, leveling means 46 are retractable leveling jacks which telescope extendably within the caster-supported ends of lower transverse frame members 30 and 31. Leveling means 46 is comprised in part of threaded shaft 47 which has crank handle 48 affixed to its upper end and foot plate 49 affixed at its lower end. Threaded shaft 47 threadably engages nut means 50 which is affixed to the outer ends of telescoping tube members 51. Telescoping tube members 51 are constructed from a length of steel tubing having an outside diameter slightly less than the internal diameter of tubular lower transverse frame members 30 and 31, thus providing a slidable fit therein. For maximum stability, resistance to sway and tip-over, lower transverse frame members 30 and 31 and telescoping tube members 51 may be constructed from square or rectangular box cross section tubing, thereby providing a non-rotating slidable fit therebetween. Further, stability may be provided by making foot plate 49 as large as practicable without its interfering with the rotation of swivel-type casters 32.

As shown in FIG. 4, mobile carriage structure 29 may be positioned with its swivel-type casters 32 elevated above ground or floor surface 52 upon leveling means 46. To facilitate the level positioning of mobile carriage structure 29 and its mounted bending frame assembly 10, a bubble level 53, shown in FIG. 1, 2 and 5, is provided. Bubble level 53 may be mounted to the top edge of upper vertical rack 54 which is mounted vertically and welded to vertical support frame members 33 and 34 and transverse bracing member 37, or alternatively, bubble level 53 may be mounted atop bending frame mounting member 39 as shown in FIG. 2. Thus, with telescoping tube members 51 extended slidably from lower transverse frame members 30 and 31, crank handle 48 is turned to elevate mobile carriage structure 29 upon leveling means 46 until the bubble within bubble level 53 is centered, which indicates that bending frame assembly 10 is positioned level. This level position is required for accurately gauging the forming of bends in pipe, conduit, tubing or the like, using the detachable leveling clamp of the present invention which will be described below.

Rack means for storing different sized bending shoes 26 comprises upper vertical rack 54 and lower vertical rack, shown generally at reference numeral 57 in FIG. 5. Upper vertical rack 54 is constructed from a plate of steel or aluminum and has sides extended to spread across vertical support frame members 33 and 34, for attachment thereto. A plurality of spaced pegs 55, constructed from a length of round bar, are attached perpendicularly to upper vertical rack 54.

When not in use, bending shoes 26 may be removably mounted on spaced pegs 55 for storage thereon. Preferably, spaced pegs 55 should be made of round bar stock, slightly less in diameter than the diameter of the aligned holes in yoke 27 of bending shoes 26. A knob 56 may be threadably attached to the topmost of spaced pegs 55 for use as a handle for maneuvering mobile carriage structure 29 upon its swivel-type casters 32.

Similarly, lower vertical rack 57, comprised of rack plate 58 and attached pegs 59, is affixed to vertical support frame member 35 for the additional storage of bending shoes 26.

As best shown in FIGS. 3 and 5, cradle means comprises shelf 60 and tray 61. Shelf 60, constructed from steel or aluminum plate stock, is affixed across the tops of lower transverse frame members 30 and 31, proximate their castered ends and their juncture with vertical support frame members 35 and 36. Tray 61, constructed in the form of a compartmented cradle with short, raised peripheral walls, is affixed atop shelf 60, spanning lower transverse frame members 30 and 31. Hydraulic pump 22 and electric motor 23 may be supported in one of the compartments of tray 61. Also, a locker 62 may similarly be supported in another of the compartments of tray 61. Locker 62 may be used for the storage of small tools, gauging instruments and accessories used when forming bends in pipe, conduit, tubing and the like.

Figure 6:
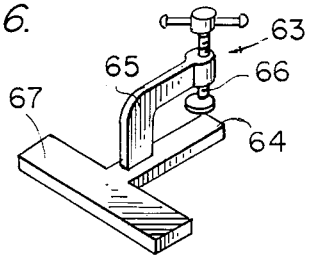
FIG. 6 is an elevation perspective view of the detachable leveling clamp of the present invention.

Detachable leveling clamp of the present invention, shown generally by reference numeral 63 in FIG. 6 and in use in FIG. 3, greatly facilitates the accurate gauging of bends, especially "following" bends, i.e. plural bends which are formed in the same plane but with their radial bending centers offset or displaced from one another. Detachable leveling clamp 63 is particularly suited for use in conjunction with three-point bending frame assemblies, such as bending frame assembly 10, which are rigidly mounted in a stationary vertical operating position on mobile carriage structure 29.

Detachable leveling clamp 63 is comprised in part of anvil 64 which is constructed from a straight length of round steel bar stock. Clamping bracket 65 is affixed, as by welding, in perpendicular relationship to and mediate the ends of anvil 64. The body of clamping bracket 65 may be constructed from a length of flat steel bar stock which is bent at a right angle mediately its ends, or may be made from a conventional "C" clamp cut apart to separate its anvil portion from its clamp portion. In either case, clamping bracket 65 is affixed to anvil 64 so as to overlie anvil 64 in the same longitudinal plane therewith. The free end of clamping bracket 65 preferably directly overlies one end of anvil 64 in spaced parallel relationship therewith, and is provided with threaded clamp screw 66, constructed in a manner similar to the construction of leveling means 46, engaging a threaded hole provided in the overlying end of clamping bracket 65 so as to be movable into an open or clamping engagement with anvil 64. Threaded clamp screw 66 is a length of threaded rod with crank handle affixed at one end and a free swiveling foot plate, slightly concave, at its opposite end, to better conform to the curved surface of a pipe.

Leveling platform 67, constructed from a length of thin steel plate, is affixed, as by welding, to anvil 64 in perpendicular relationship therewith, opposite the clamp screw-engaging end of anvil 64. Leveling platform 67 is further aligned in perpendicular relationship with the overlying plane of clamping bracket 65. In use, leveling platform 67 can hold a leveling device on either the top or bottom surface of the length of thin steel plate.

The operation of detachable leveling clamp is shown generally at reference numeral 63 in FIG. 3, along with the preferred method of these inventors for gauging bends. There is shown a length of conduit 68 in which a bend is being formed in bending frame assembly 10. Detachable leveling clamp 63 is inserted into one end of conduit 68 prior to the forming of the bend. Threaded clamping screw 66 is advanced downwardly, towards anvil 64, to firmly engage the wall of conduit 68 therebetween. A "torpedo" level 69 is then laid lengthwise upon leveling platform 67 and conduit 68 may be turned until "torpedo level" 69 indicates a level position. Hydraulic ram 21 is then advanced downwardly just enough to bring bending shoe 26 into engagement with conduit 68. A protractor level 70, with a magnetic base, is then laid atop one end of conduit 68. The desired degree of bend to be formed is "dialed in" by rotating the indexed dial face of protractor level 70 until the desired index mark is aligned with the baseline. Hydraulic ram 21 is then advanced gradually downward, under control of the pressure extend/release lever, not shown, until the bubble in the spirit level vial of protractor level 70 is centered, thereby indicating that the bend has been formed as desired.

Where conduit 68 is of aluminum or other nonferrous material, it is preferred to set protractor level 70 upon leveling platform 67 of detachable leveling clamp 63, in place of "torpedo" level 69, once conduit 68 has been engaged by bending shoe 26. In this manner it is possible to use a protractor level with a magnetic base for gauging bends being formed in nonferrous pipe, conduit, tubing or the like.

When is is desired to form "following" bends, such as "S" bends, in the same plane in conduit 68, detachable leveling clamP 63 proves especially useful. After the initial bend has been formed, hydraulic ram 21 is retracted upwardly until bending shoe 26 disengages from conduit 68. Conduit 68 is then advanced the required distance upon concave rollers 13 and 14 until the center point for the "following" bend is aligned with hydraulic ram 21. Using "torpedo" level 69 and detachable leveling clamp 63, said clamp being still clamped to one end of conduit 68, it is quite easy to once again turn conduit 68 until "torpedo" level 69 indicates its original level position. Thereupon hydraulic ram 21 is again advanced downwardly to bring bending shoe 26 into engagement with conduit 68. Protractor level 70 is then set for the desired "following" degree of bend and hydraulic ram 21 advanced gradually downward until protractor level 70 indicates the desired degree of bend has been reached.

Where the centers of "following" bends, such as "S" bends are to be formed, are on opposite sides of conduit 68, it is necessary to turn conduit 68 over after framing the first bend. By engaging detachable leveling clamp 63 with conduit 68 before forming the first bend and setting conduit 68 level using "torpedo" level 69, it is possible to accurately align the "following" bend in the plane of the first bend simply by setting turned-over conduit 68 once again level with "torpedo" level 69, placed upon leveling platform 67, before forming each of the "following" bends.

It should be understood that while the operations thus described referred to the forming of bends on conduit, this description was not intended to be a limitation as the present invention is suitable for use with pipe, conduit, tubing and the like.

We claim:

1. In combination with a conventional three-point bending frame having two opposing frame plates, each of said plates having at each of its opposite ends an aperture, said apertures being located proximate the lower edge of said frame plate, a mobile pipe bending carriage, for storing and transporting bending equipment used in making radius bends in pipe, conduit, tubing and the like, which comprises:

a mobile carriage structure of welded frame construction having two opposed horizontal lower transverse frame members the ends of which are supported by large swivel-type casters for mobility, four opposed vertical support members, two transverse bracing members, and having mounting attachment means for mounting thereon a conventional three-point bending frame assembly, comprising two opposed bending frame mounting members each of which extends horizontally across the upper ends of two of said vertical support members, in parallel relationship with said transverse bracing member, the inner opposing vertical faces of said bending frame mounting members having a plurality of drilled and tapped holes aligned in to horizontal rows at regularly centered intervals, and two hub plates, affixed to the inner opposing vertical faces of said bending frame mounting members, each said hub plates comprising a cylindrical hub affixed perpendicularly to a plate having drilled through holes at its four corners which holes are arranged so as to align with said drilled and tapped holes provided along the inner opposing vertical faces of said bending frame mounting members, said cylindrical hub of each hub plate fitting into said apertures on said frame plates for supporting said three-point bending frame upon said mobile carriage.

* * * * *